US005491862A

United States Patent [19]

Hurley

[11] Patent Number: 5,491,862

[45] Date of Patent: Feb. 20, 1996

[54] CHIMNEY SCRAPER

[76] Inventor: Bruce P. Hurley, 251 Northwest Bailey Ave., Hillsboro, Oreg. 97124

[21] Appl. No.: 356,629

[22] Filed: Dec. 15, 1994

[51] Int. Cl.[6] ..... F23J 3/02

[52] U.S. Cl. ..... 15/104.068; 15/104.066; 15/144.3; 15/236.05; 15/236.07; 15/236.08; 30/169; 30/171; D32/49

[58] Field of Search ..... 15/144.3, 162, 15/163, 236.01, 236.05–236.09, 242, 243, 249, 104.066–104.069, 249.1–249.3; 30/169, 171, 172; D32/46, 49

[56] References Cited

U.S. PATENT DOCUMENTS

| | | | |
|---|---|---|---|
| D. 24,178 | 4/1895 | Hoffmann | D32/46 |
| 789,258 | 5/1905 | Connolly | 15/144.3 |
| 1,101,283 | 6/1914 | Howd | 15/249 |
| 1,210,850 | 1/1917 | Scarr | 30/169 |
| 1,256,402 | 2/1918 | Ware | 15/249 |
| 1,361,708 | 12/1920 | Garretson | 15/249 |
| 2,264,230 | 11/1941 | Anderson | 15/242 |
| 3,091,791 | 6/1963 | Czapar, Jr. | 15/236.01 |
| 3,516,106 | 6/1970 | Roefaro | 15/236.05 |
| 4,028,769 | 6/1977 | Coviello et al. | 15/243 |
| 4,490,879 | 1/1985 | Colby | 15/242 |

*Primary Examiner*—Mark Spisich

[57] ABSTRACT

A scraper for removing deposits from an interior of a chimney. The inventive device includes an elongated handle having a scraping plate attached to a lower end thereof for engaging and scraping the interior surfaces of the chimney. The scraping plate can be rectangular, semi-circular, or quarter-round in shape so as to accommodate a plurality of disparate chimney interior shapes.

9 Claims, 7 Drawing Sheets

CHIMNEY SCRAPER

BACKGROUND OF THE INVENTION

1. Field of the Invention

The present invention relates to cleaning implements and more particularly pertains to a chimney scraper for removing deposits from an interior of a chimney.

2. Description of the Prior Art

The use of cleaning implements is known in the prior art. More specifically, cleaning implements heretofore devised and utilized are known to consist basically of familiar, expected and obvious structural configurations, notwithstanding the myriad of designs encompassed by the crowded prior art which have been developed for the fulfillment of countless objectives and requirements.

Known prior art cleaning implements include U.S. Pat. Nos. 4,757,573; 4,538,317; 4,454,625; 4,409,703; and 4,085,477.

While these devices fulfill their respective, particular objectives and requirements, the aforementioned patents do not disclose a chimney scraper for removing deposits of an interior of a chimney which includes an elongated handle having a scraping plate attached to the lower end thereof for engaging and scraping interior surfaces of the chimney. Furthermore, none of the known prior art cleaning implements teach or suggest a chimney scraper in which the scraping plate can be rectangular, semi-circular, or quarter-round in shape so as to accommodate a plurality of disparate chimney interior shapes.

In these respects, the chimney scraper according to the present invention substantially departs from the conventional concepts and designs of the prior art, and in so doing provides an apparatus primarily developed for the purpose of removing deposits from an interior of a chimney.

SUMMARY OF THE INVENTION

In view of the foregoing disadvantages inherent in the known types of cleaning implements now present in the prior art, the present invention provides a new chimney scraper construction wherein the same can be utilized for scraping the interior surfaces of a chimney. As such, the general purpose of the present invention, which will be described subsequently in greater detail, is to provide a new chimney scraper apparatus and method which has many of the advantages of the cleaning implements mentioned heretofore and many novel features that result in a chimney scraper which is not anticipated, rendered obvious, suggested, or even implied by any of the prior art cleaning implements, either alone or in any combination thereof.

To attain this, the present invention generally comprises a scraper for removing deposits from an interior of a chimney. The inventive device includes an elongated handle having a scraping plate attached to a lower end thereof for engaging and scraping the interior surfaces of the chimney. The scraping plate can be rectangular, semi-circular, or quarter-round in shape so as to accommodate a plurality of disparate chimney interior shapes.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new chimney scraper apparatus and method which has many of the advantages of the cleaning implements mentioned heretofore and many novel features that result in a chimney scraper which is not anticipated, rendered obvious, suggested, or even implied by any of the prior art cleaning implements, either alone or in any combination thereof.

It is another object of the present invention to provide a new chimney scraper which may be easily and efficiently manufactured and marketed.

It is a further object of the present invention to provide a new chimney scraper which is of a durable and reliable construction.

An even further object of the present invention is to provide a new chimney scraper which is susceptible of a low cost of manufacture with regard to both materials and labor, and which accordingly is then susceptible of low prices of sale to the consuming public, thereby making such chimney scrapers economically available to the buying public.

Still yet another object of the present invention is to provide a new chimney scraper which provides in the apparatuses and methods of the prior art some of the advantages thereof, while simultaneously overcoming some of the disadvantages normally associated therewith.

Still another object of the present invention is to provide a new chimney scraper for removing deposits from an interior of a chimney.

Yet another object of-the present invention is to provide a new chimney scraper which includes an elongated handle having a scraping plate attached to the lower end thereof for engaging and scraping interior surfaces of the chimney.

Even still another object of the present invention is to provide a new chimney scraper in which the scraping plate can be rectangular, semi-circular, or quarter-round in shape so as to accommodate a plurality of disparate chimney interior surfaces.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
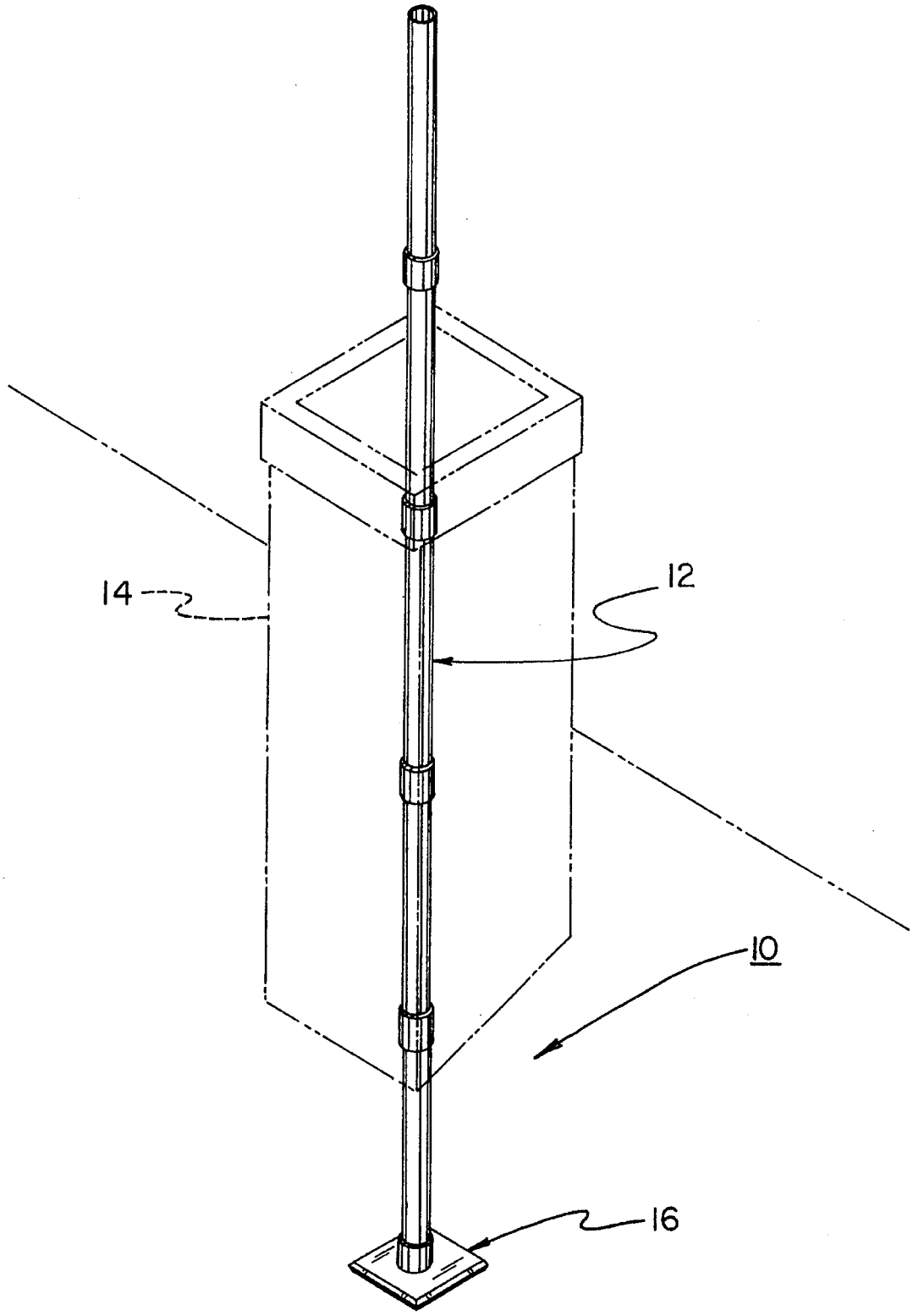
FIG. 1 is an isometric illustration of a chimney scraper according to the present invention in use.

With reference now to the drawings, and in particular to FIGS. 1–14 thereof, a new chimney scraper embodying the principles and concepts of the present invention and generally designated by the reference numeral 10 will be described.

Figure 2:
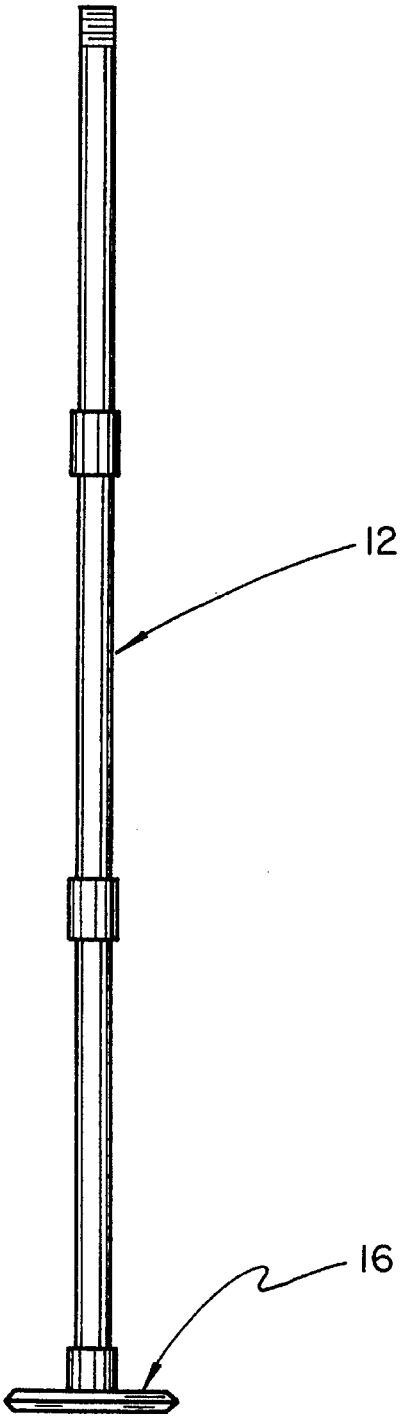
FIG. 2 is a front elevation view thereof.
Figure 3:
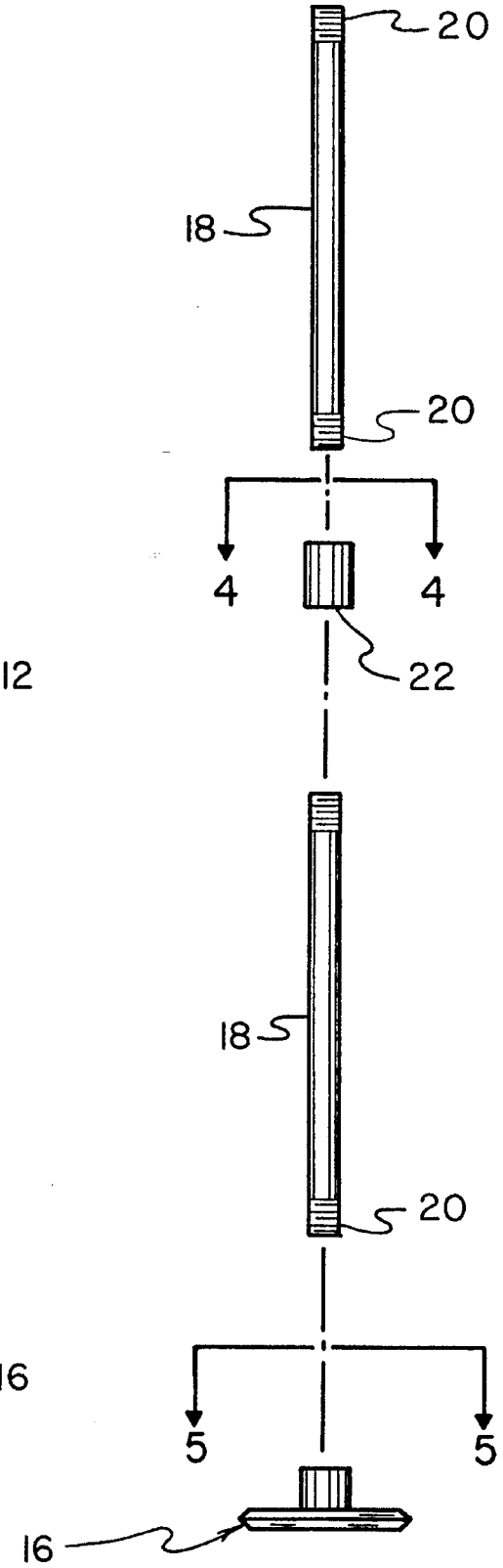
FIG. 3 is an exploded elevation view of the chimney scraper.
Figure 4:
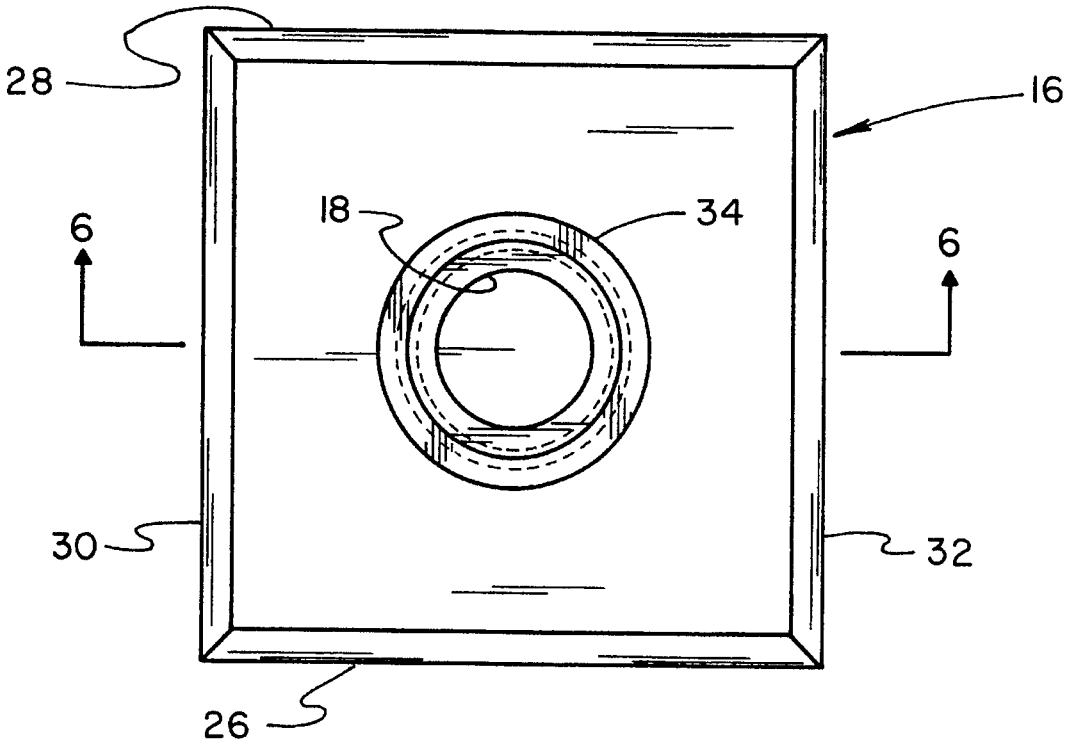
FIG. 4 is a top plan view of the present invention taken from line 4—4 of FIG. 3.
Figure 5:
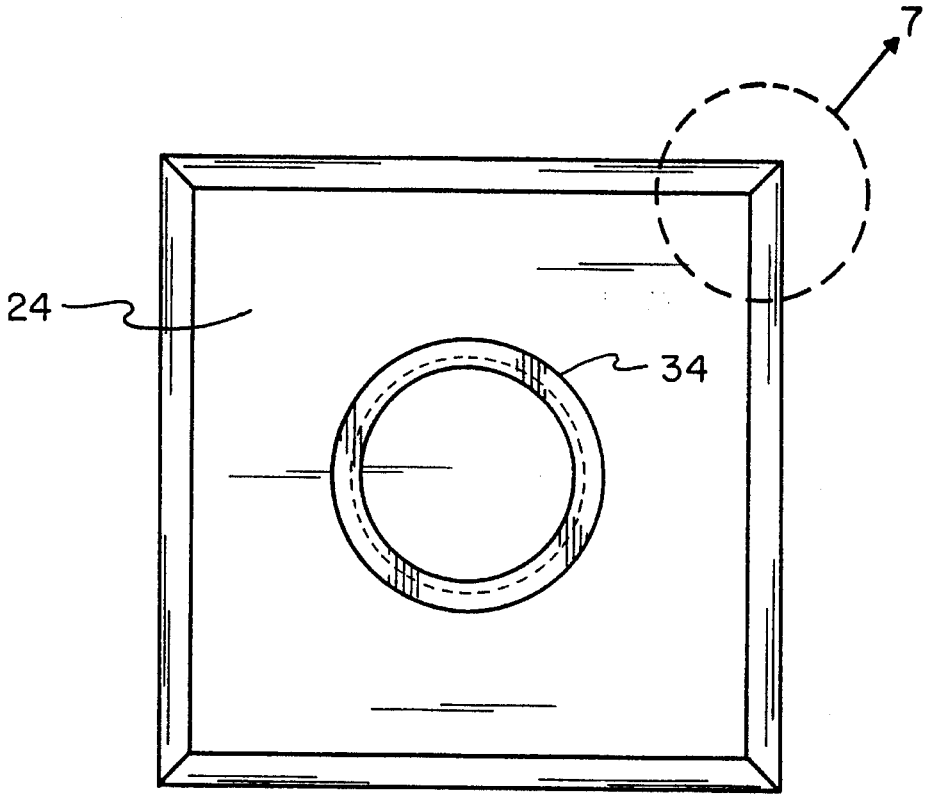
FIG. 5 is a further top plan view of the present invention taken from line 5—5 of FIG. 3.

More specifically, it will be noted that the chimney scraper 10 comprises a handle means 12 for being grasped and manipulated within a chimney 14 by an individual, and a scraping means 16 coupled to a lower end of the handle means 12 for engaging and scraping interior surfaces of the chimney 14. As best illustrated in FIGS. 2 and 3, the handle means 12 preferably comprises a plurality of tubular members 18 having threaded ends 20, and a plurality of hollow couplers 22 having cooperatively threaded interior surfaces. Thus, the hollow couplers 22 may be utilized to join adjacent tubular members 18 together through a threaded engagement of the threaded ends 20 within the hollow couplers. By this structure, the handle means 12 can be easily adjusted to a desired length, and can further be collapsed compactly for storage and/or transportation purposes.

Turning now to FIGS. 4 through 7, wherein the scraping means 16 is illustrated in detail, it can be shown that the same comprises a rectangular scraping plate 24 having a first side 26 spaced from a second side 28, wherein the first and second sides are substantially parallel relative one to another. Further, the rectangular scraping plate 24 includes a third side 30 spaced from a fourth side 32, with the third and fourth sides being orthogonally oriented relative to the first and second sides 26, 28. Accordingly, the third and fourth sides 30, 32 are substantially parallel as well. Preferably, the sides 26–32 are all of an equal length such that the rectangular scraping plate 24 is substantially square in shape. To facilitate removable coupling of the scraping plate 24 of the scraping means 16 to a lower end of the handle means 12, a mounting boss 34 having a threaded interior surface threadably receives and engages a threaded end 20 of the lowermost tubular member 18 of the handle means 12. Thus, the scraping means 16 can be easily coupled and decoupled from the handle means 12.

Figure 6:
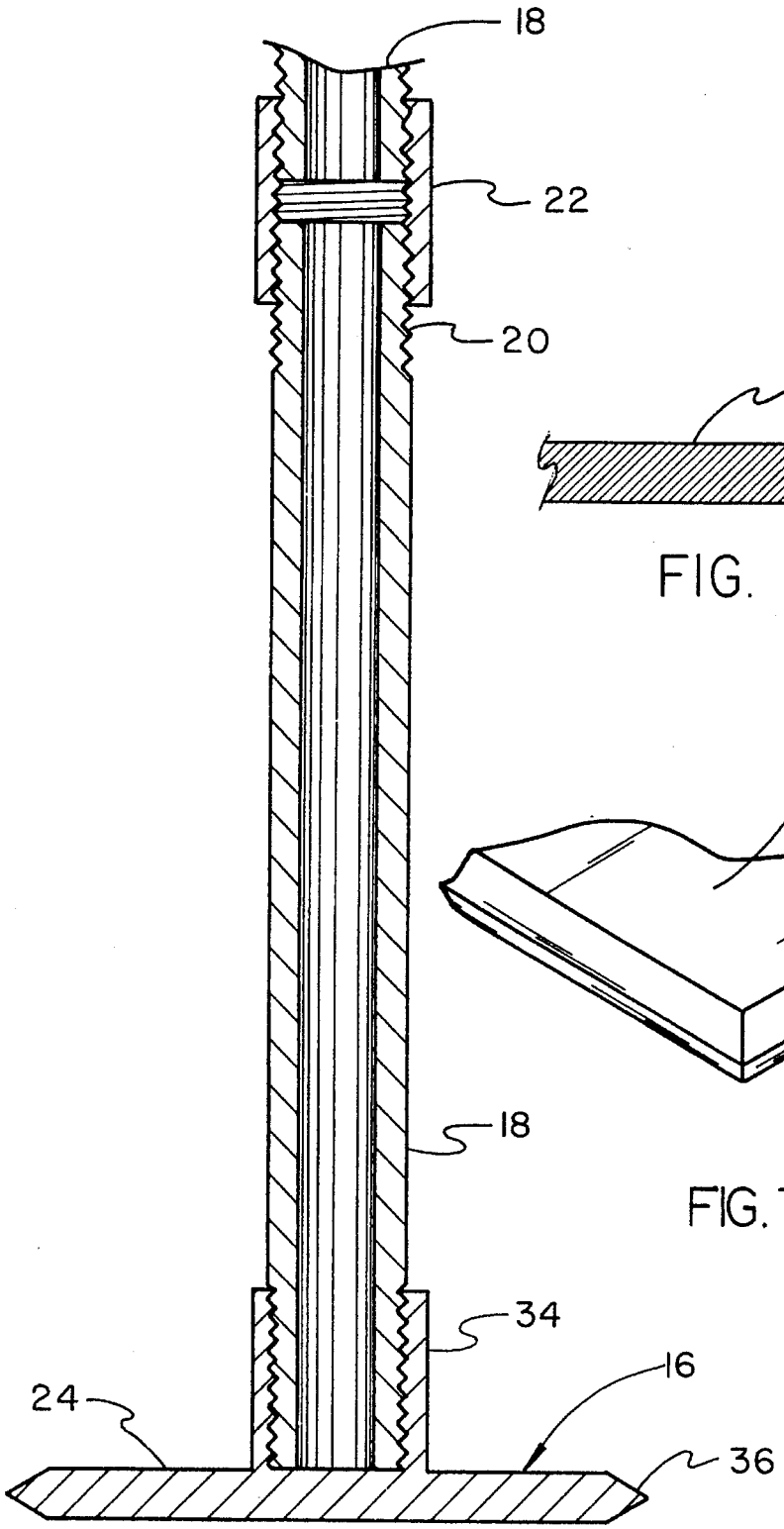
FIG. 6 is a cross-sectional view taken along line 6—6 of FIG. 4.
Figure 7A:
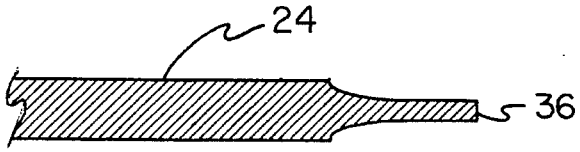
FIG. 7A is an enlarged cross sectional illustration of a knife edge of the scraping plate.
Figure 7:
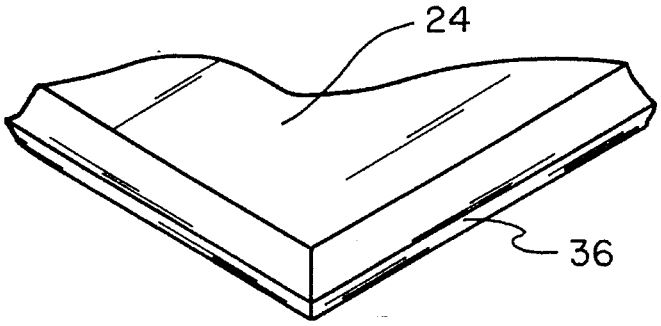
FIG. 7 is an enlarged isometric illustration of the area set forth in FIG. 5.

As shown in FIGS. 6, 7, and 7A, the scraping plate 24 of the scraping means 16 is shaped so as to define a double knife edge 36 extending along at least one of the sides 26–32 thereof. The knife edge 36 is defined by cooperating bevels and preferably extends about all four of the sides 26–32 such that any of the sides can be utilized to engage and scrape the interior surface of the chimney 14 being cleaned. Alternatively and as shown in FIG. 7A, the knife edge 36 can be defined by cooperating arcuate inverse bevel which reduce a cross section thickness of the scraping plate and terminate in a flat outer edge. Preferably, the knife edge 36 illustrated in FIG. 7A also extends about all four of the sides 26–32 of the scraping plate 24.

Figure 8:
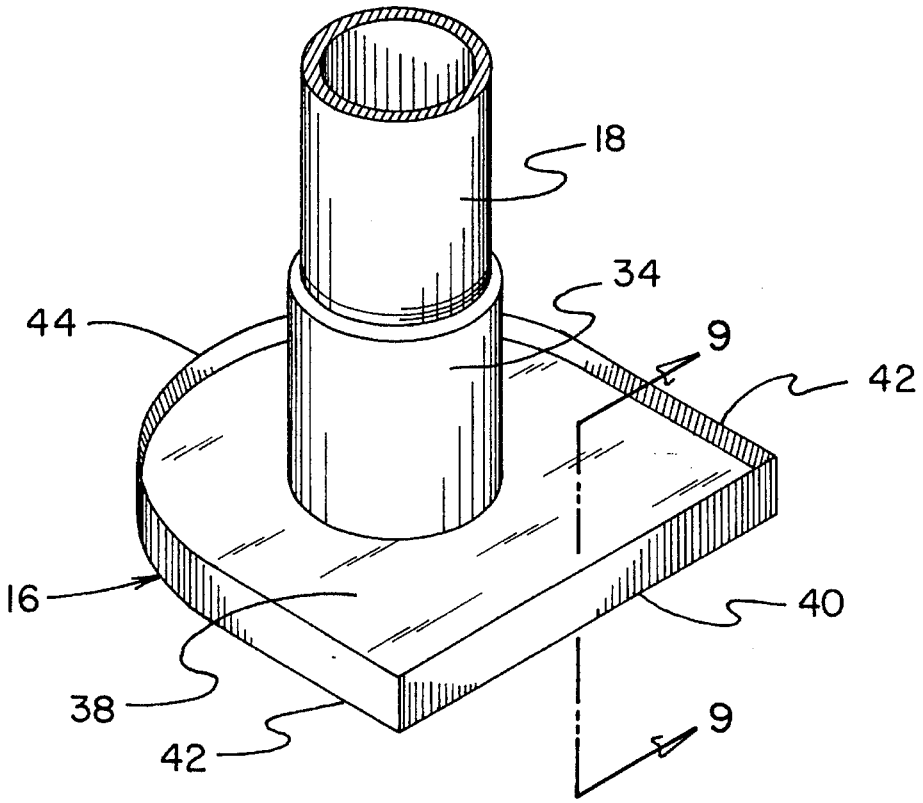
FIG. 8 is an isometric illustration of a portion of the chimney scraper detailing an alternative scraping means.
Figure 10:
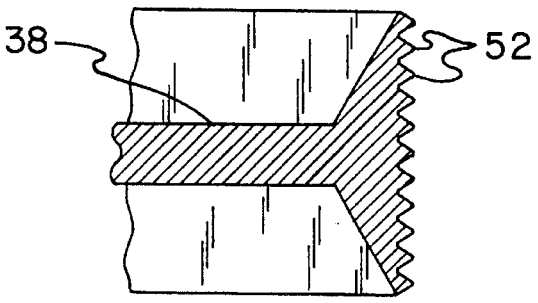
FIG. 10 is a further cross-sectional view illustrating the addition of a plurality of serrations along an exterior of the alternative scraping means.
Figure 9:
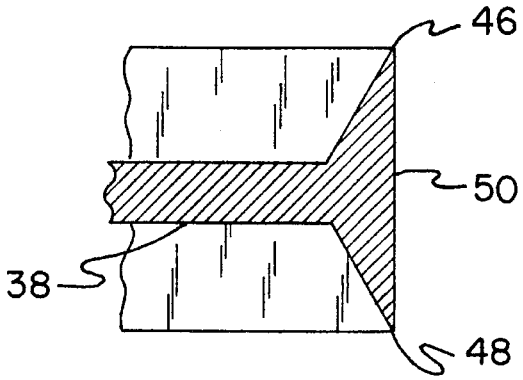
FIG. 9 is a cross-sectional view taken along line 9—9 of FIG. 8.
Figure 11:
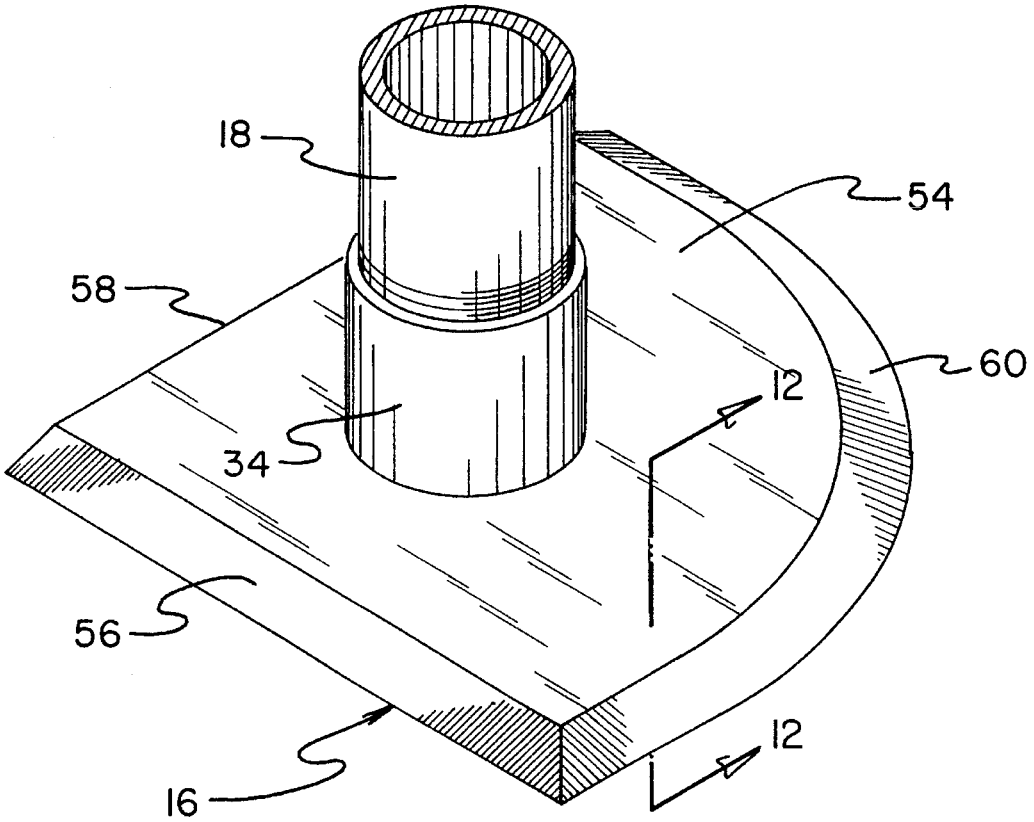
FIG. 11 is an isometric illustration of a portion of the present invention detailing a further alternative scraping means.

Turning now to FIGS. 8 through 10, it can be shown that the scraping means 16 may alternatively comprise a semi-circular scraping plate 38 having a straight unlabelled edge along which a straight perimeter flange 40 extends. A pair of lateral perimeter flanges 42 extend from respectively opposed ends of the straight perimeter flange 40 and continue into an arcuate perimeter flange 44, as shown in FIG. 8. The flanges 40–44 are shaped so as to define an upper perimeter edge 46 spaced from a lower perimeter edge 48, with the perimeter edges preferably tapering to a point suitable for engaging and scraping the interior surfaces of the chimney 14. The flanges 40–44 can be provided with a smooth exterior surface 50, as shown in FIG. 9, or alternatively, can be provided with a plurality of serrations 52 extending along the exterior surface thereof to facilitate increased mechanical separation of deposits from the interior of the chimney 14 during use of the device 10. The semi-circular scraping plate 38, because of its combined straight and arcuate shape, can facilitate the cleaning of a plurality of disparate chimney interior surfaces.

Figure 12:
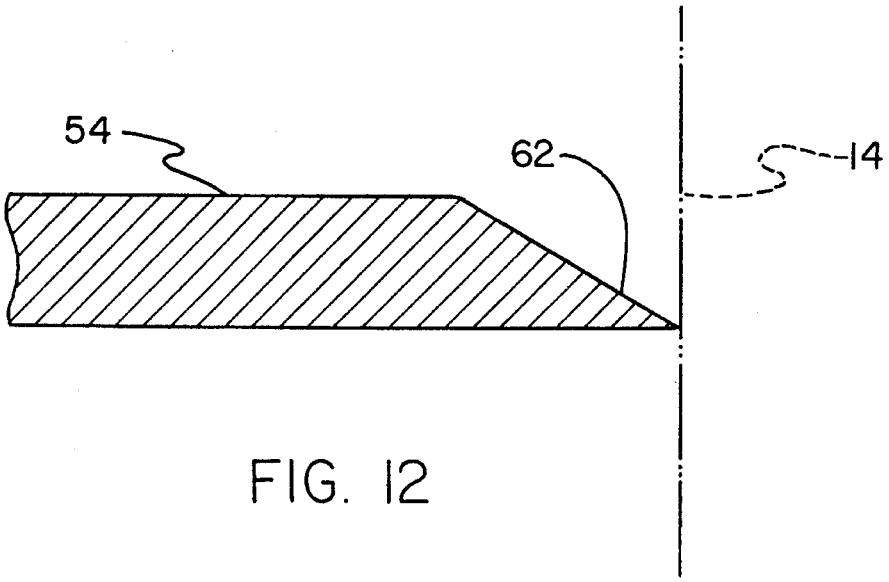
FIG. 12 is a cross-sectional view taken along line 12—12 of FIG. 11.

As shown in FIGS. 1 and 2, the scraping means 16 may further alternatively comprise a quarter-round scraping plate 54 having a first edge 56 orthogonally oriented relative to a second edge 58, with an arcuate edge 60 extending through a ninety degree arc to connect outer ends of the first and second edges. The quarter-round scraping plate 54 is preferably shaped so as to define a chisel edge 62 extending about the first and second edges 56, 58, as well as the arcuate edge 60. The chisel edge 62, as shown in FIG. 12, tapers to a sharp point which is operable to engage and scrape the interior surface of the chimney 14 being cleaned.

Figure 13:
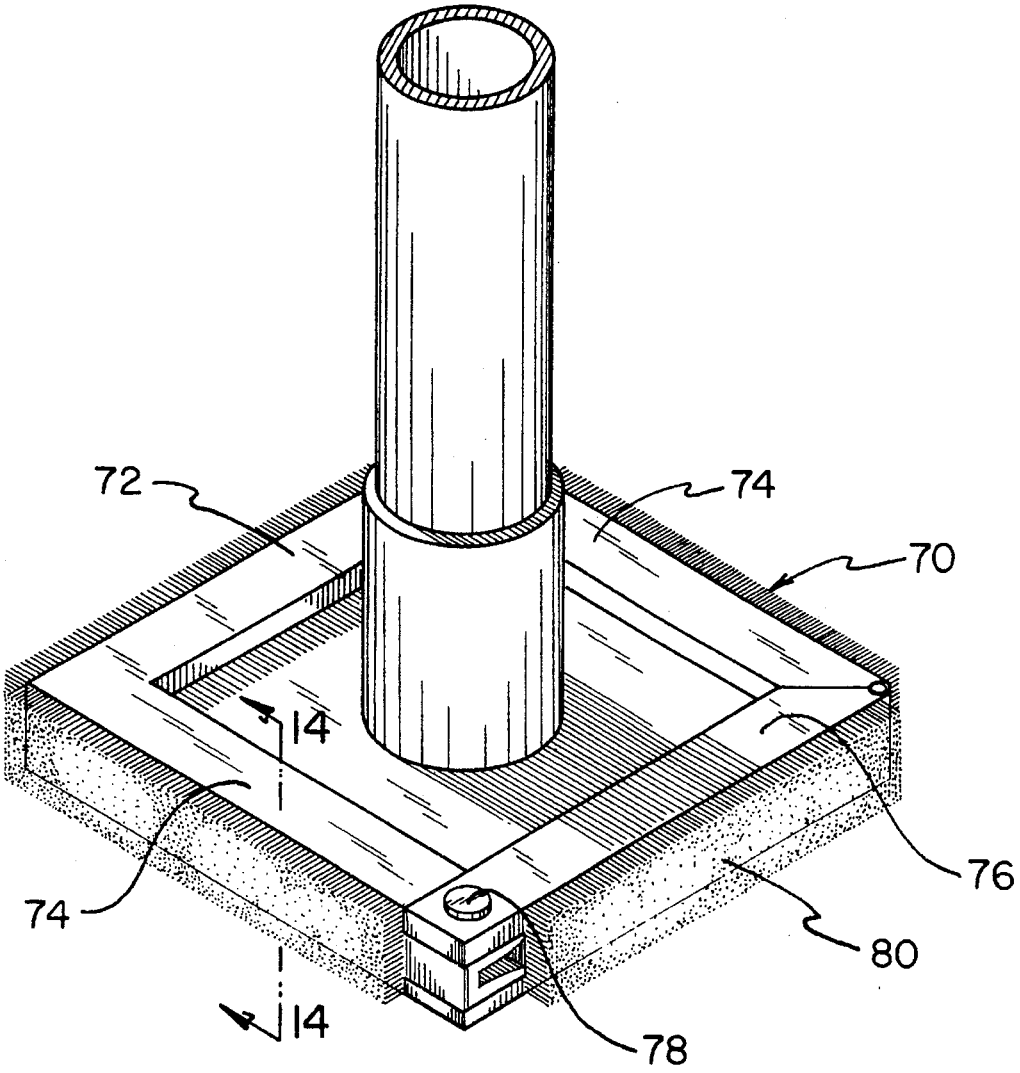
FIG. 13 is an isometric illustration of the invention including a brush cover extending about the scraping plate.
Figure 14:
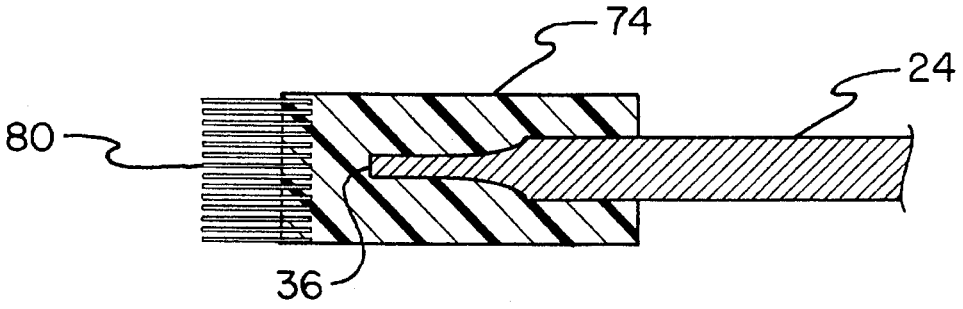
FIG. 14 is a cross-sectional view taken along line 14—14 of FIG. 13.

Referring to FIGS. 13 and 14, it can be shown that the present invention 10 may additionally comprise a removable brush cover means 70 for covering the knife edge 36 of the scraping plate 24 and for brushing an interior surface of a chimney. The brush cover means 70 thus comprises a rear cover member 72 having spaced ends, with lateral cover members 74 projecting substantially orthogonally from the ends of the rear cover member. A front cover member 76 is pivotally mounted to a first one of the lateral cover members 74 and releasably coupled by a removable fastener 78 to a second one of the lateral cover members to secure the brush cover means 70 about the scraping plate 24, as shown in FIG. 13. A plurality of bristles 80 extend from the cover members 72–76 and are operable to engage an interior surface of a chimney or the like to effect mechanical cleaning thereof.

In use, the chimney scraper 10 according to the present invention can be easily assembled through a rotatable engagement of the tubular members 18 to the couplers 22, with the lowermost tubular member 18 being threadably engaged to the scraping means 16. Depending upon the shape of the interior surfaces of the chimney 14 to be cleaned, any one of the three scraping means 16 can be utilized. After an attaching of the scraping means 16 to the lowermost tubular member 18, the device 10 can be inserted within a chimney 14 to be cleaned and manually reciprocated therewithin to effect cleaning and scraping of the interior surfaces thereof. Such cleaning will reduce the amount of creosote present along interior surfaces of the chimney. Creosote has been found to increase the likelihood of a chimney fire when present along the interior surfaces of a chimney. Thus, the present invention 10 significantly reduces the amount of creosote within an associated chimney, and consequently, reduces the risk of unintentional combustion therewithin.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A chimney scraper comprising:

a handle means for grasping and manipulating by an individual within a chimney, said handle means comprising a plurality of tubular members having threaded ends, and a plurality of hollow couplers having threaded interior surfaces, wherein said hollow couplers are operable to join said tubular members together; and, a scraping means coupled to a lower end of said handle means for engaging and scraping interior surfaces of said chimney, said scraping means comprising a semi-circular scraping plate having a straight edge along which a straight perimeter flange extends; a pair of lateral perimeter flanges extending from respectively opposed ends of said straight perimeter flange; and an arcuate perimeter flange connecting said lateral perimeter flanges, said flanges being shaped so as to define an upper perimeter edge spaced from a lower perimeter edge, with said perimeter edges tapering to a point for engaging and scraping the interior surfaces of said chimney.

2. The chimney scraper of claim 1, wherein said flanges are shaped so as to define smooth exterior surfaces.

3. The chimney scraper of claim 1, wherein said flanges are shaped so as to define a plurality of serrations extending along exterior surfaces thereof.

4. A chimney scraper comprising:

a scraping means for engaging and scraping interior surfaces of a chimney, said scraping means comprising a semi-circular scraping plate having a straight edge along which a straight perimeter flange extends; a pair of lateral perimeter flanges extending from respectively opposed ends of said straight perimeter flange; and an arcuate perimeter flange connecting said lateral perimeter flanges, said flanges being shaped so as to define an upper perimeter edge spaced from a lower perimeter edge, with said perimeter edges tapering to a point for engaging and scraping the interior surfaces of said chimney.

5. The chimney scraper of claim 4, wherein said flanges are shaped so as to define smooth exterior surfaces.

6. The chimney scraper of claim 4, wherein said flanges are shaped so as to define a plurality of serrations extending along exterior surfaces thereof.

7. A chimney scraper comprising:

a scraping means for engaging and scraping interior surfaces of a chimney, said scraping means comprising a semi-circular scraping plate; and an arcuate perimeter flange extending along an edge of said semi-circular scraping plate, with said arcuate perimeter flange being shaped so as to define an upper perimeter edge spaced from a lower perimeter edge, with said perimeter edges of said arcuate perimeter flange tapering to a point for engaging and scraping the interior surfaces of said chimney.

8. The chimney scraper of claim 7, and further comprising a pair of lateral perimeter flanges extending along respectively opposed lateral edges of said semi-circular scraping plate, with said lateral perimeter flanges each being shaped so as to define an upper perimeter edge spaced from a lower perimeter edge, with said perimeter edges of said lateral perimeter flanges tapering to a point for engaging and scraping the interior surfaces of said chimney.

9. The chimney scraper of claim 7, and further comprising a straight perimeter flange extending along a straight edge of the semi-circular scraping plate, with said straight perimeter flange being shaped so as to define an upper perimeter edge spaced from a lower perimeter edge, with said perimeter edges of said straight perimeter flange tapering to a point for engaging and scraping the interior surfaces of said chimney.

* * * * *